US005409308A

United States Patent [19]

Reuter et al.

[11] Patent Number: 5,409,308

[45] Date of Patent: Apr. 25, 1995

[54] OVERHEAD CABINET WITH ROTATING DOOR

[75] Inventors: Robert E. Reuter, Stony Brook, N.Y.; Robert E. Anderson, Palm, Pa.

[73] Assignee: Westinghouse Electric Corporation, Pittsburgh, Pa.

[21] Appl. No.: 201,142

[22] Filed: Feb. 24, 1994

Related U.S. Application Data

[63] Continuation of Ser. No. 937,633, Aug. 28, 1992, abandoned.

[51] Int. Cl.[6] ..... A47B 88/00

[52] U.S. Cl. ..... 312/319.4; 312/328; 16/289; 49/206

[58] Field of Search ..... 312/319.2, 319.4, 327, 312/328; 220/334; 16/289, DIG. 7; 49/203, 204, 206, 246, 386

[56] References Cited

U.S. PATENT DOCUMENTS

| | | | |
|---|---|---|---|
| D. 278,010 | 3/1985 | Ostrander . | |
| 586,476 | 7/1897 | Coates | 16/289 X |
| 1,068,391 | 7/1913 | Jensen . | |
| 1,115,345 | 10/1914 | Steuernagel . | |
| 1,115,465 | 10/1914 | Goddin . | |
| 2,376,966 | 3/1945 | Ingerman . | |
| 2,551,305 | 5/1951 | Tompkins | 312/328 |
| 2,590,028 | 3/1952 | Miller . | |
| 2,648,516 | 8/1953 | Manetti et al. . | |
| 2,689,101 | 9/1954 | Dygert . | |
| 2,853,352 | 9/1958 | Gittins . | |
| 3,539,239 | 11/1970 | Mallonn . | |
| 4,076,203 | 2/1978 | McDonnell . | |
| 4,167,298 | 9/1979 | Plattner | 312/284 X |
| 4,383,721 | 5/1983 | Knaack et al. | 312/319.4 X |
| 4,706,333 | 11/1987 | Lauderback | 16/289 |
| 4,953,985 | 8/1989 | Perry | 16/289 X |
| 4,966,403 | 10/1990 | Nordstrom | 16/289 X |
| 5,050,943 | 9/1991 | Barnett | 312/319.4 X |
| 5,172,969 | 12/1992 | Reuter et al. . | |

FOREIGN PATENT DOCUMENTS

| | | |
|---|---|---|
| 2089842 | 12/1971 | France . |
| 2091715 | 12/1971 | France . |

OTHER PUBLICATIONS

*The Complete Hafele*, pp. 5.30–5.31, Jul. 1988.

*Primary Examiner*—Brian K. Green

*Attorney, Agent, or Firm*—Carla J. Vrsansky

[57] ABSTRACT

A cabinet is provided with a curved, upwardly-swinging door and interior shelves. The curved shelf door is mounted on a pair of opposed pivot arms which rotate on a horizontal axis. Each pivot arm is provided with a disk portion having a central boss and an arm portion tangent to the disk portion. The central boss engages a fixed stud at the side of the cabinet and provides a center pivot for each of the arms. A gas spring for each arm is provided, which is pivotably connected at one end to the arm and at the other end to a side wall of the cabinet. The gas spring serves a dual purpose of counterbalancing the door as it moves between an open and a closed position and opening the door unassisted once the user initiates movement of the door, this opening feature being very beneficial to seated and physically disabled users.

10 Claims, 5 Drawing Sheets

OVERHEAD CABINET WITH ROTATING DOOR

This is a continuation of application Ser. No. 07/937,633, filed on Aug. 28, 1992, now abandoned.

CROSS-REFERENCED UNITED STATES PATENT

This Application is related to commonly-assigned U.S. Pat. No. 5,172,969, issued Dec. 22, 1992, entitled "Overhead Cabinet With Rotating Door". This cross-referenced United States patent is hereby incorporated by reference in its entirety.

BACKGROUND OF THE INVENTION

1. Field of the Invention

The present invention relates to cabinets having upwardly-movable or rotatable doors. More specifically the invention relates to cabinets with upwardly-movable, self-opening, curved doors that require little effort on the part of the user, whereby the user simply begins opening the door by rotating the door upwardly a specified distance and then releasing the door, the door then continuing to the open position unassisted by the user. Furthermore, the cabinet provides greater interior space to accomodate shelves and other interior fixtures since the door is stored outside the cabinet when in the open position.

2. Related Art

Conveniently located and easily accessible storage space is highly desirable and often required in the office environment. In modular office furniture systems, one way of providing storage space adjacent a work area is to mount a cabinet or shelf vertically above, and spaced apart from, a desk or work surface. Typically, such cabinets are secured to a vertical modular wall panel adjacent the work surface. This type of mounting arrangement enables the furniture designer to efficiently use storage space which ordinarily is unused, above the office worker's head.

However, vertical mounting of storage cabinets creates certain furniture design problems. For example, when movable doors are used to conceal the contents of overhead storage cabinets, convenient means to raise and lower the door must be provided. Since the office worker must reach up and push the door upward to open the door, the door must be either relatively light in weight or provided with a balancing system to facilitate upward movement. In fact, providing a door with self-opening capabilities whereby the user need only exert a minimum of effort to open the door is most desirable, especially in today's society with the ever increasing concern about providing accessible work areas to disabled workers due in part to the recent passage of the Americans with Disabilities Act of 1990.

The direction of motion chosen for the door is also critical. The door can be constructed to swing into the cabinet structure or outside the structure. In the prior art, "pocket" doors are well known, and combine a hinge and drawer slide to enable the door to be swung up and then pushed on the slide into the cabinet. However, such pocket doors reduce the usable interior volume of the cabinet because the door occupies interior space when retracted. Furthermore, door structures in which the retracted door swings outside and above the cabinet structure are well known in the art. These doors provide added interior volume to the cabinet but can be heavy or cumbersome and may create extra effort by the user to open the door and swing it outside and above the cabinet. Consequently, there exists a need to provide door structures in which the retracted door swings outside and above the cabinet structure, but also is easy to open with little effort required by the user, in particular the seated or physically disabled user. Such a door structure, mounted on pivot arms, is disclosed in commonly-assigned U.S. Pat. No. 5,172,969, entitled "Overhead Cabinet With Rotating Door," issued Dec. 22, 1992, which is incorporated herein by reference in its entirety. The present invention constitutes an alternative to the door structure and the mounting mechanism disclosed in commonly-assigned U.S. Pat. No. 6,172,969, and more particularly provides a door having self-opening capabilities, whereby the user need only exert a minimal beginning force to initiate door movement followed by a releasing of the door which will continue to open completely without any additional assistance by the user, in particular the seated or disabled user.

SUMMARY OF THE INVENTION

In accordance with the present invention, a cabinet is provided with a curved, upwardly-swinging door and interior shelves. The curved door is mounted adjacent its bottom edge to a pair of opposed arms which rotate on a horizontal axis and are mounted inside the cabinet adjacent opposed interior side walls. An opening mechanism for each arm is provided which is pivotably connected at one end to the arm and at the other end to a side wall of the cabinet. The opening mechanism serves a dual purpose, providing counterbalance capabilities as well as opening capabilities, whereby the cabinet door may be opened unassisted once movement is initiated by a user by initially opening the door a predetermined distance and then releasing the door which continues to an open position without any further assistance by the user.

BRIEF DESCRIPTION OF DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
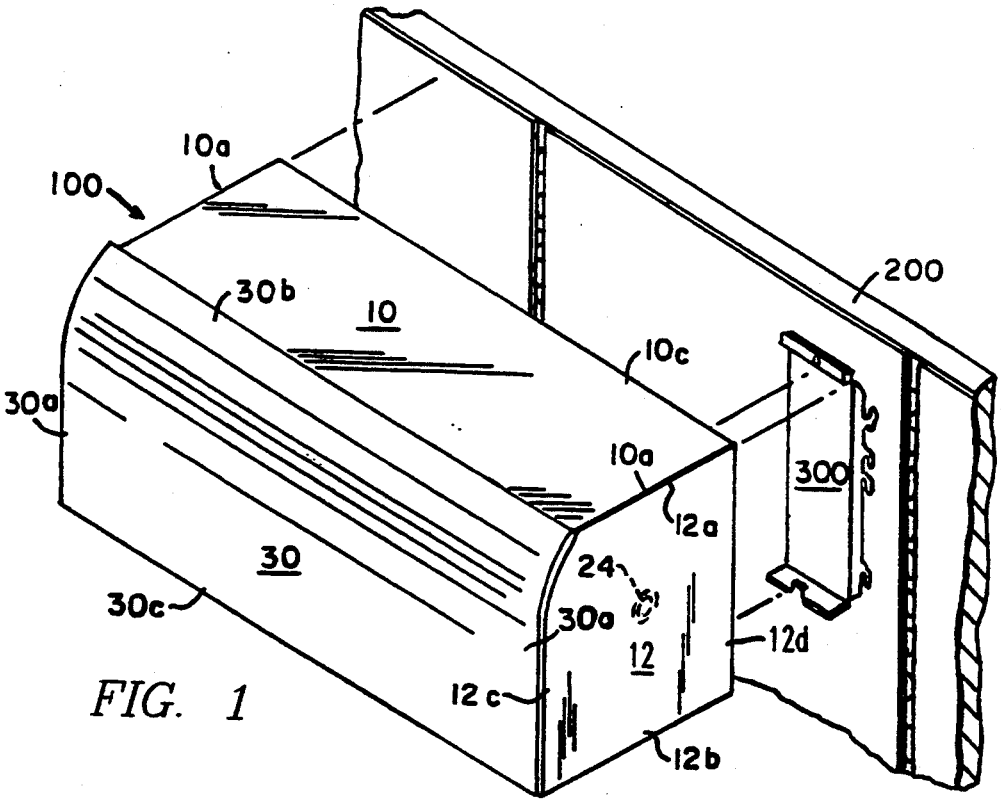
FIG. 1 is a partially exploded perspective view of a cabinet according to the present invention shown with a mounting bracket for mounting the cabinet to a supporting wall structure.

In the following detailed description of the preferred embodiments, specific terminology is used for the sake of clarity. However, the present invention is not intended to be limited to the specific terms used, and it is to be understood that each element includes all technical equivalents which operate in a substantially similar manner to accomplish a substantially similar purpose.

Referring now to FIGS. 1 through 5, there is shown a preferred embodiment of a cabinet 100 according to the present invention. Cabinet 100 is adapted for mounting on a modular furniture panel assembly 200 by a pair of mounting brackets 300, substantially as disclosed in commonly-assigned U.S. Pat. No. 5,172,969, issued Dec. 22, 1996.

As shown in FIGS. 1 through 5, cabinet 100 also is substantially as disclosed in commonly-assigned U.S. Pat. No. 5,172,969, issued Dec. 22, 1992, comprising a generally rectangular box having a generally rectangular top wall 10 having opposed side edges 10*a* (FIGS. 1 and 2), opposed front and back edges 10*b* and 10*c* (FIGS. 1 and 3–5), and a fascia strip 10*d* (FIGS. 2–5) extending downwardly from front edge 10*b*; two symmetrically identical, opposed side walls 12 (FIGS. 1–5) each having opposed top and bottom edges 12*a* and 12*b* (FIGS. 1–5) and opposed front and back edges 12*c* and 12*d* (FIGS. 1 and 3–5); a generally rectangular bottom wall 14 (FIGS. 2–5) having opposed side edges 14*a* (FIG. 2) and opposed front and back edges 14*b* and 14*c* (FIGS. 3–5); and a rectangular rear wall 16 (FIGS. 2–5) having opposed side edges 16*a* (FIG. 2), and opposed top and bottom edges 16*b* and 16*c* (FIGS. 2–5).

Figure 3:
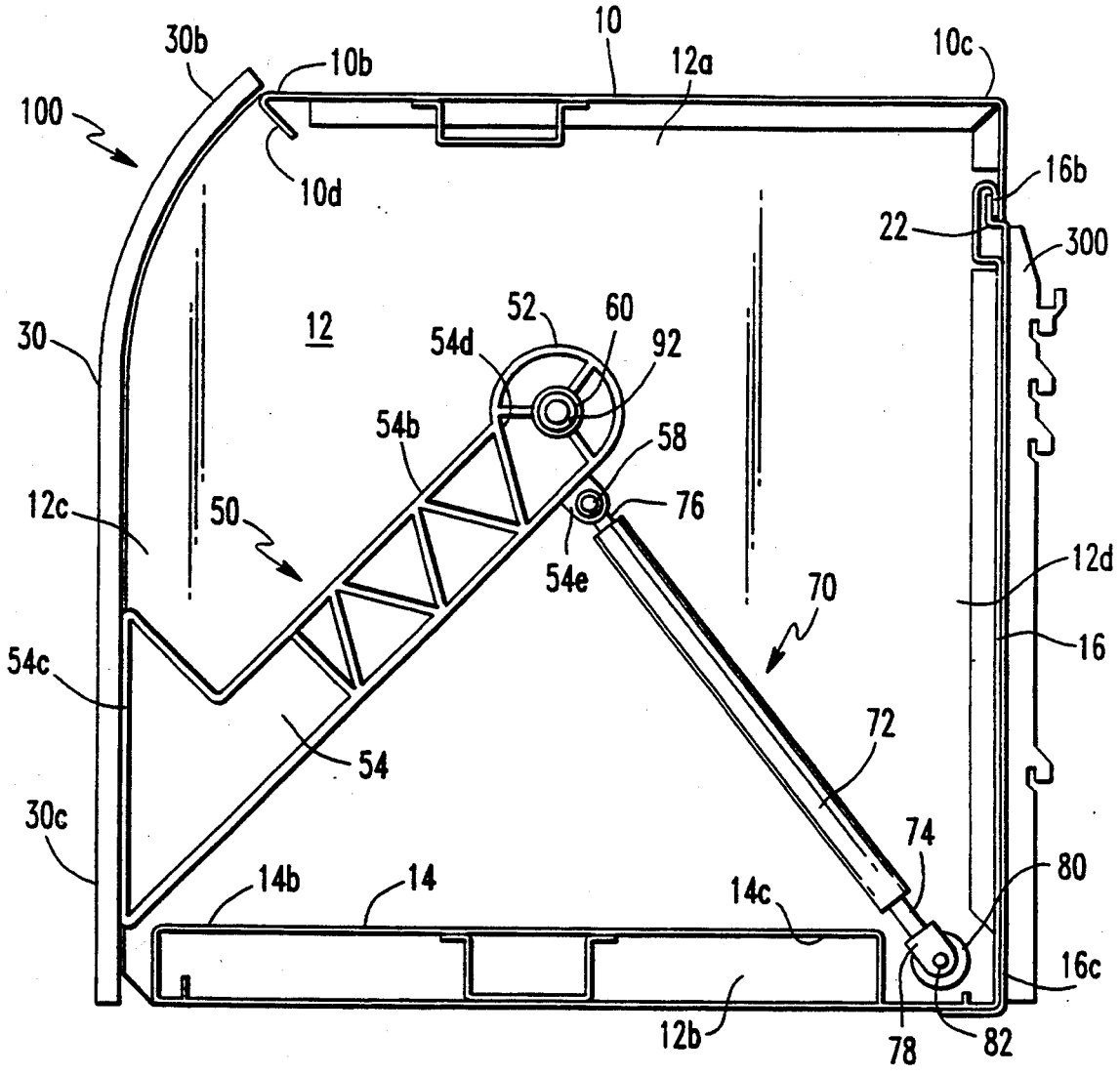
FIG. 3 is a cross-sectional view taken along line 3—3 of FIG. 2, and showing the mounting bracket assembled to the cabinet.
Figure 4:
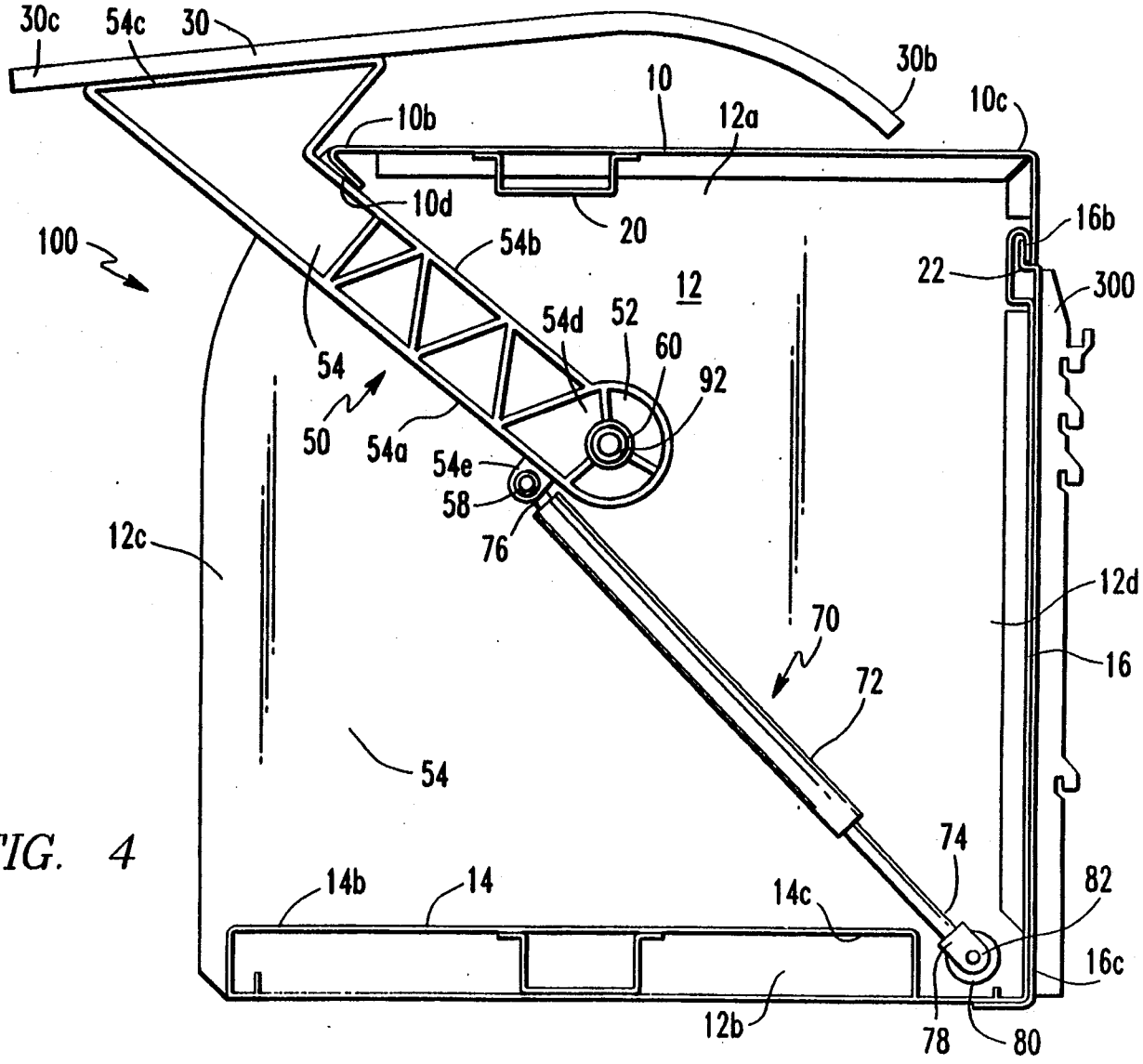
FIG. 4 is a cross-sectional view similar to FIG. 3, but showing the cabinet with the door in the raised, open position.
Figure 5:
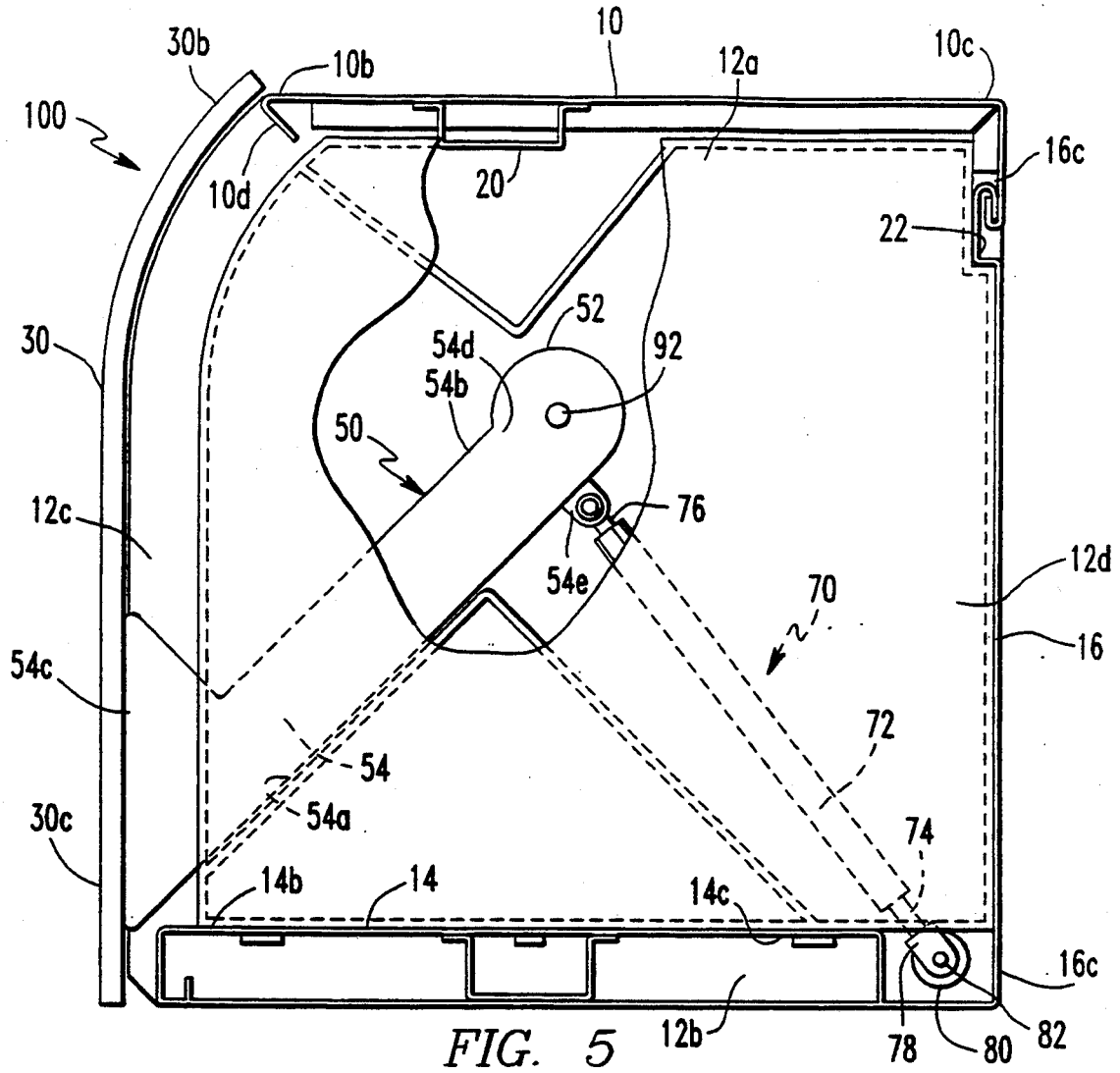
FIG. 5 is a cross-sectional view taken along line 5—5 of FIG. 2, with parts broken away.

As shown in FIGS. 3–5, a guide channel 20 is secured to the lower surface of top wall 10 intermediate front and back edges 10*a* and 10*b*, for a purpose to be described hereinafter; and rear wall 16 is provided with an inwardly formed, horizontally-elongated channel 22, for receiving mounting brackets 300. Also, each of side walls 12 has formed therein an inwardly extending, central stud 24 (FIG. 1), for a purpose to be described hereinafter.

An upwardly-movable cabinet door 30 (FIGS. 1–5) generally similar to that disclosed in commonly-assigned U.S. Pat. No. 5,172,969, issued Dec. 22, 1992, selectively provides access to the interior of cabinet 100. Door 30 includes opposed side edges 30*a* (FIGS. 1 and 2) and opposed top and bottom edges 30*b* and 30*c* (FIGS. 1 and 3–5), and is substantially planar adjacent bottom edge 30*c* and arcuate adjacent top edge 30*b*.

Figure 2:
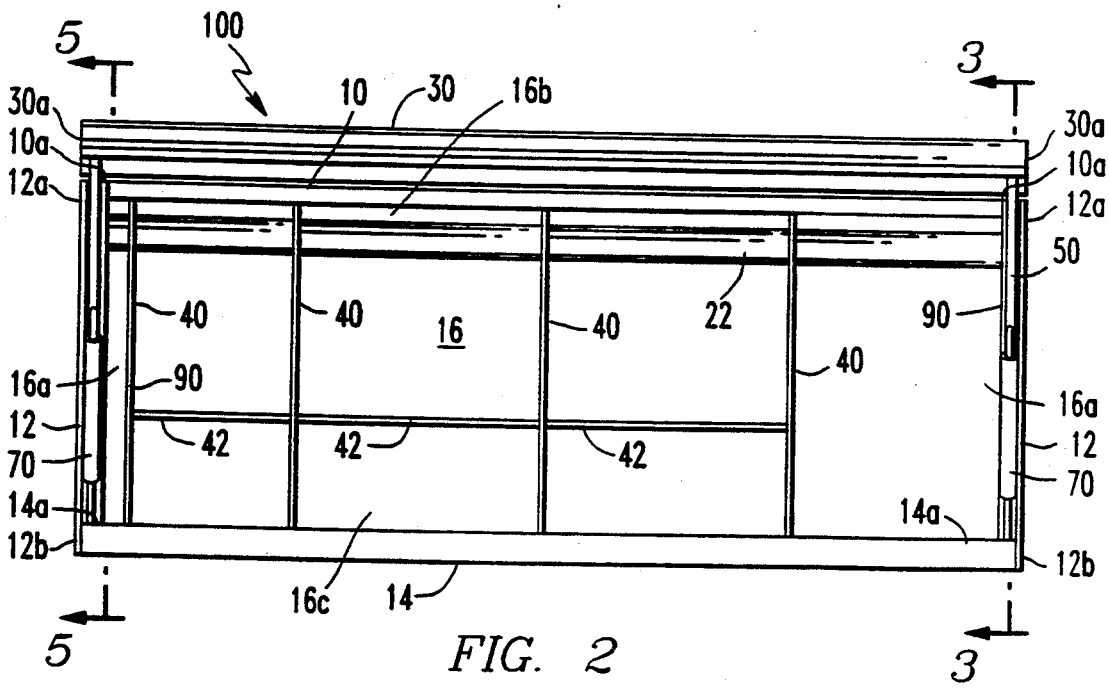
FIG. 2 is a front elevational view of the cabinet of FIG. 1 shown with the door in the raised, open position.

Referring now to FIG. 2, cabinet 100 is shown with door 30 in the raised position. Cabinet 100 is provided with plural vertical shelf brackets 40 engageable with guide channel 20, and plural horizontal shelves 42 supported between adjacent shelf brackets 40, in a manner substantially identical to that disclosed in commonly-assigned U.S. Pat. No. 5,172,969, issued Dec. 22, 1992.

The structure and operation of the upwardly movable door 30 will now be described. As indicated in FIGS. 3 through 5, door 30 is operated using plural planar, rigid door pivot arms 50, which are pivotably mounted to the inner surfaces of end walls 12, as will be described in greater detail hereinafter. Pivot arms 50 preferably are fabricated of injection molded plastic, but can be fabricated of material such as sheet aluminum or sheet steel.

In the preferred embodiment, two pivot arms 50 are provided, one at each of sides 30*a* of door 30. Pivot arms 50 serve to movably connect sides 30*a* of door 30 to end walls 12 of cabinet 100 while restricting the movement of door 30 to an arcuate path. As best shown in FIG. 2, each arm 50 is positioned immediately adjacent one of end walls 12. This arrangement ensures that a minimum of interior cabinet space is occupied by the door operating mechanism.

As best shown in FIGS. 3–8, arm 50 comprises a circular disk portion 52 integrally formed with a tangential arm portion 54 and a mounting bracket 56, as shown in FIGS. 3–7. Arm portion 54 has a substantially linear first side 54*a* formed as a tangent of disk portion 52; an L-shaped second side 54*b* a portion of which is parallel to first side 54*a* and a portion of which is substantially perpendicular to first side 54*a*; an outer end 54*c* which joins first and second sides 54*a* and 54*b*; and an inner end 54*d* which is coextensive with the circumference of disk portion 52. Side 54*a* forms an angle of approximately 45° with outer end 54*c*.

Mounting bracket 56 extends perpendicularly from tangential arm portion 54 inwardly of outer end 54*c* for mounting pivot arm 50 to door 30 adjacent bottom edge 30*c*. Thus, when door 30 is closed as shown in FIGS. 3 and 5, side 54*a* is arranged at an angle of approximately 45° relative to horizontal. Preferably, mounting bracket 56 is formed integrally with tangential arm portion 54. Also, door 30 can be mounted to mounting bracket 56 by conventional screws inserted through threaded apertures 56*a* in mounting bracket 56.

A gas spring mounting pin 58 extends perpendicularly from a protrusion 54*e* on side 54*a*, adjacent disk portion 52, for a purpose to be described hereinafter. Mounting pin 58 is inserted into protrusion 54*e* during the injection molding process.

Disk portion 52 is provided with a central boss 60 for receiving stud 24 positioned on the inside of each of end walls 12 of cabinet 100, by which each of arms 50 is mounted on its respective end wall 12 and about which each of arms 50 pivots.

Referring now to FIGS. 2–5, door 30 is counterbalanced by force providing means in the form of a gas spring 70 comprising a cylinder 72 provided with a reciprocating piston (not shown) and piston rod 74, and having a cylinder end and a rod end. The specifications of gas spring 70 for any given size and weight door can be calculated in a well-known manner. For example, doors having a nominal width of 24, 30, 33, 36, 42 and 48 inches respectively employ a pair of gas springs exerting a force of 15, 19, 22, 24, 31 and 33 psi respectively. Gas spring 70 serves a dual purpose, acting both as a means to counterbalance the weight of door 30 and as a means of opening door 30 unassisted once the user initiates the opening of door 30 by rotating the door to an angle of approximately 15 to 20 degrees and then releasing the door.

At its cylinder end, gas spring 70 is provided with a cylinder clevis 76 for pivotably connecting cylinder 72 to mounting pin 58 of arm 50; while at its rod end, it is provided with a rod clevis 78 for pivotably connecting piston rod 74 to a fixed mounting bracket or stud 80 (FIGS. 3–5) positioned at the lower rear corner of each of end walls 12.

Figure 9:
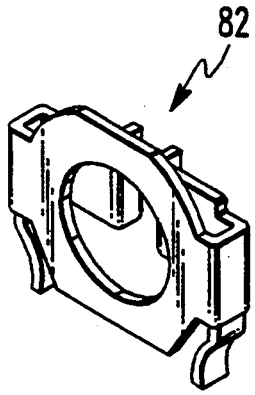
FIG. 9 is a perspective view of a spring clip for attaching a gas spring to the mounting arm and the cabinet.

Gas spring 70 is secured to mounting pin 58 of arm 50 and to mounting bracket 80 on end wall 12 by small spring clips 82, shown in FIG. 9, which slide over clevises 76 and 78 and are press fit over mounting pin 58 and mounting bracket 80, respectively. Suitable spring clips 82 are commercially available as part no. PC 119 from AVM, Inc. of Marion, S.C.

As shown in FIGS. 3–5, preferably, the rod end of gas spring 70 is positioned facing downwardly, with the cylinder end facing upwardly, to keep the oil in cylinder 72 on the cylinder seal (not shown), to extend the life expectancy of the gas.

Gas springs 70 are designed in a known manner to assist the door 30 in opening after they have rotated approximately 15–20 degrees. Gas springs 70 also provide a closing assist feature whereby the user need only exert limited force to overcome the force of the gas spring to close the door at a controlled rate rather than slamming shut. The motion of door 30 is curtailed at the top of its arc by striking against sound-deadening bumper 94 (FIG. 6), as will be described in greater detail hereinafter.

By using arm 50 in conjunction with gas spring 70, arm 50 can be made visually appealing and gas spring 70 does not have to be mounted directly to door 30. Further, cover panels 90 can be provided at each of end walls 12, as shown in FIGS. 2 and 5, to conceal gas springs 70 and most of pivot arms 50.

Figure 6:
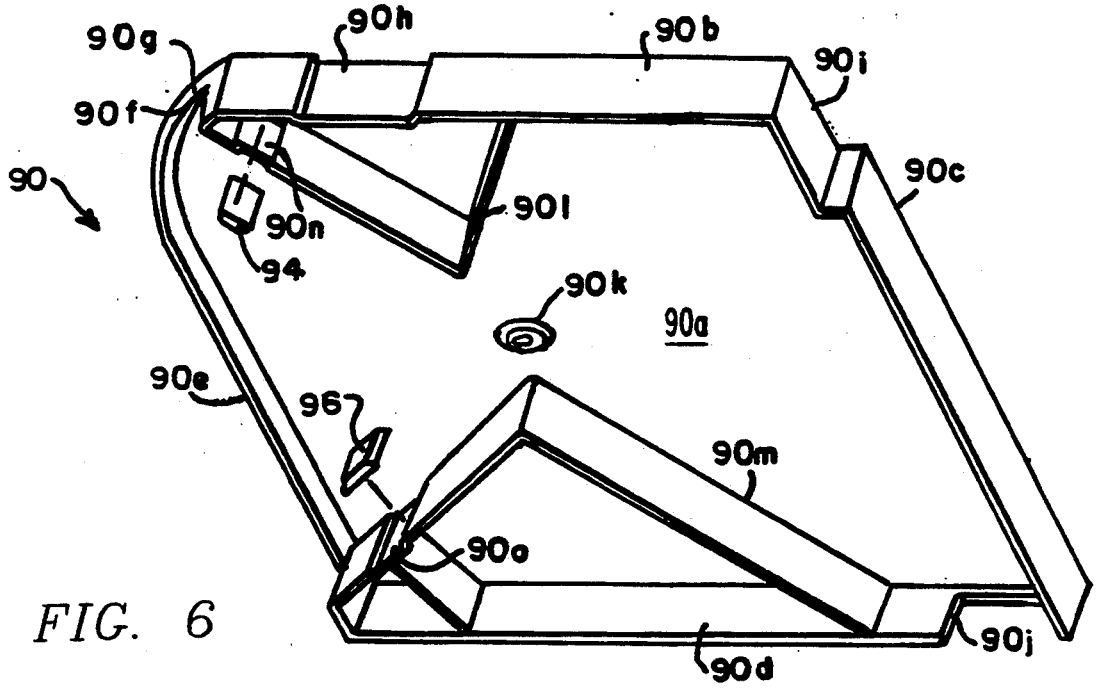
FIG. 6 is a perspective view of a cover plate for the mounting are shown in FIG. 3.
Figure 7:
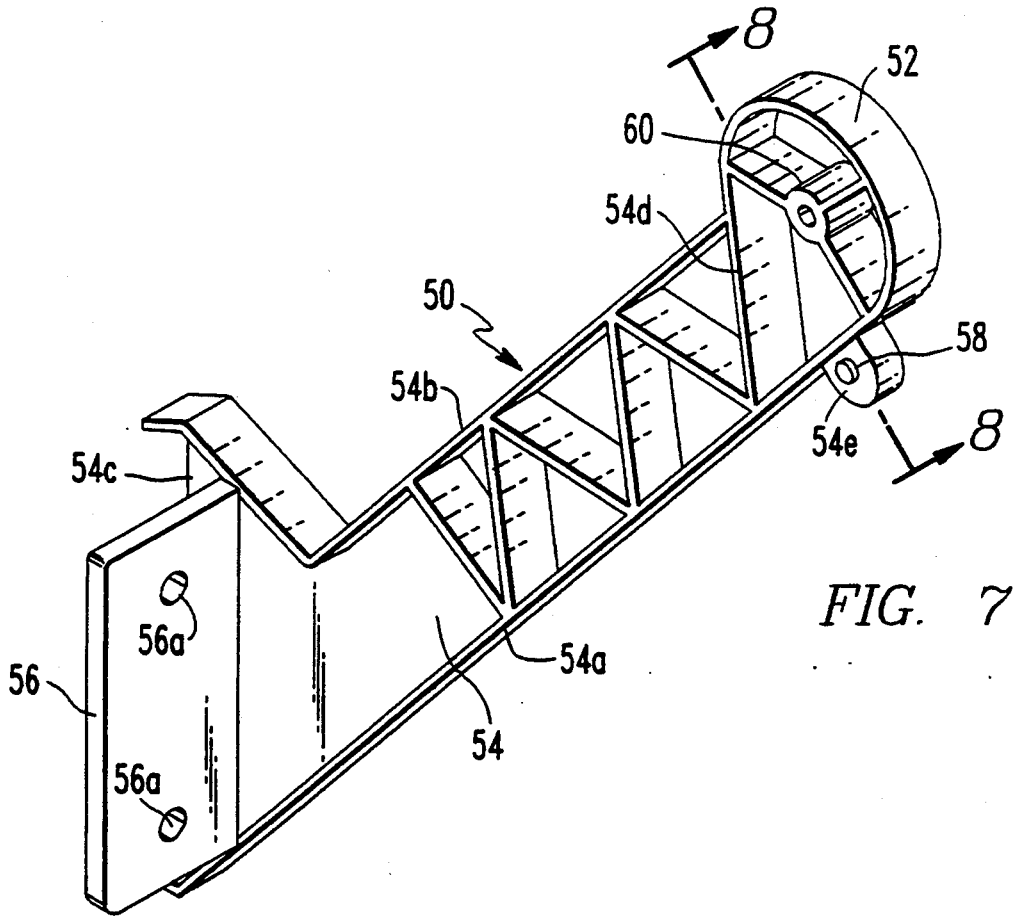
FIG. 7; is a perspective view of the mounting arm shown in FIG. 3.
Figure 8:
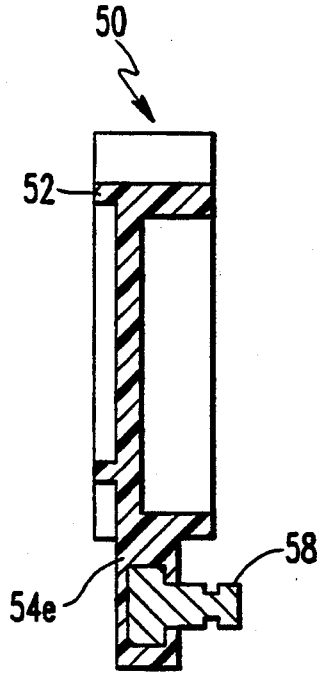
FIG. 8 is a cross-sectional view taken along line 8—8 of FIG. 7.

Although only one cover panel 90 is shown in detail, in FIG. 6, it should be understood that the cover panels 90 at either side of cabinet 100 (as shown in FIG. 2) are mirror images of each other. Referring now to FIGS. 5 and 6, each of cover panels 90 is generally rectangular in shape, having a side wall **90*a*, and projecting outwardly from side wall 90*a* a top wall 90*b*, a rear wall 90*c*, a bottom wall 90*d*, and a front wall 90*e*. Although each cover panel 90 is generally rectangular, front wall 90*e* is connected to top wall 90*b* by an arcuate corner portion 90*f* generally parallel to the arcuate profile of door 30**.

Front wall **90*e* and arcuate corner portion 90*f* have a continuous notch 90*g* formed at the edge thereof along substantially its entire length, to provide clearance for arm 50 as it moves between the open and closed position. Also, top wall 90*b* has an inset portion 90*h* spaced rearwardly from arcuate corner portion 90*f*, for receiving guide channel 20; and the corner formed by top wall 90*b* and rear wall 90*c* defines an inset 90*i*, for receiving elongated channel 22. Bottom wall 90*d* has a notch 90*j* formed therein adjacent rear wall 90*c*, to provide clearance for piston rod 74 of gas spring 70, as shown in FIG. 5**.

Side wall **90*a* is provided with a central boss 90*k* for receiving a flat-head screw 92 for securing each cover panel 90 and pivot arm 50 to its respective end wall 12. Upper and lower, substantially V-shaped reinforcing ribs 90*l* and 90*m* are also formed in side wall 90*a*, extending respectively inwardly from top wall 90*b* and bottom wall 90*d*. The forward arms of ribs 90*l* and 90*m* have respective insets 90*n* and 90*o* for receiving upper and lower bumpers 94 and 96, respectively, and in conjunction with bumpers 94 and 96 limit upward and downward travel of door 30**.

Cover panel 90 also is provided with a central, inwardly-projecting boss **90*k* as shown in FIG. 6 which registers with boss 60 of arm 50 and stud 24 of side wall 12, for attaching cover panel 90 to side wall 12. Preferably, cover panels 90 are injection molded plastic and are fastened to studs 24 by flat head machine screws 92. Cover panels 90 are removable to provide for quick field replacement of a defective gas spring 70**.

When the cabinet door 30 is moved upwardly to an angle of rotation of approximately 15 to 20 degrees using manual force, arm 50 rotates around boss 60, causing cylinder 72 and piston rod 74 to move apart relative to one another as they rotate respectively at clevises 76 and 78. More specifically, it will be noted in FIG. 3, that the centerline of gas spring 70 is only slightly offset from the center 60 of disk portion 52 of arm 50 when the door is in a closed position. In this closed position the force generated by gas spring 70 is restrained since it is substantially directed through the pivot point. When the door is manually opened approximately 15 to 20 degrees, the pivot point between gas spring 70 and arm 50 moves slightly forward of the cabinet causing the force generated by gas spring 70 to now be essentially tangential to rotatably mounted disk 52. Thus, when the user initiates movement of cabinet door 30, the user may then release door 30 permitting door 30 to move for the remainder of its travel solely under the force of gas spring 70. The moving apart motion of cylinder 72 and piston rod 74 at a controlled rate provides a smooth continuing motion enabling door 30 to open completely without any further effort by the user.

The invention having a preferred embodiment described above may be practiced in many ways other than as specifically described. For example, the rotatable arms can be used to rotatably mount a door in an article of furniture other than the cabinets described herein, or to rotatably mount articles other than a door. Also, the rotatable arms can be used to mount rotatable, side-by-side doors in a cabinet, in a manner similar to that described in commonly-assigned U.S. Pat. No. 5,172,969 issued Dec. 22, 1992. Therefore, within the scope of the appended claims, the invention should be considered to include all technically equivalent structures functioning in a substantially similar manner to achieve substantially similar results.

We claim:

1. An overhead storage cabinet having an upwardly movable door, said cabinet comprising:

a top wall, a bottom wall and first and second opposed, parallel side walls;

a door having opposed top and bottom edges and opposed side edges;

a pair of pivot arm means for moving said door between a closed position and a fully open position situated above said cabinet each pivot arm means having a disk portion, a protrusion perpendicularly adjacent to said disk portion and an elongated arm portion extending outwardly from said disk portion and having a mounting bracket at its far end opposite said disk portion, said disk portion being rotatably mounted about its center to one of said side walls, and said elongated arm portion being secured to said door; and a pair of force means coacting with said pivot arm means for moving and counterbalancing said door as said door moves between said closed and fully open positions, each of said force means comprising a reciprocable piston and cylinder constructed and arranged to move said door to its open position without assistance once movement of said door is initiated, one end of said piston and cylinder being pivotally connected to said protrusion on said pivot arm means and the other end of said piston and cylinder being pivotally connected to said side wall, whereby when said door is in said closed position, said reciprocable piston and cylinder is only slightly offset from said center of said disk portion of said pivot arm means and when said movement of said door is initiated to cause said door to move to said open position, said protrusion at which said piston and cylinder is pivotally connected to said pivot arm means moves slightly forward toward said door, thereby redirecting the force generated by said reciprocable piston and cylinder to be essentially tangential to said disk portion of said pivot arm means thus permitting said door to move for the remainder of its travel solely under the force generated by said force means.

2. The overhead cabinet according to claim 1 wherein said force means is constructed and arranged to move said door between said open and closed positions at a controlled rate once movement of said door is initiated a predetermined distance.

3. The overhead cabinet according to claim 2 wherein said predetermined distance equals a rotation angle of approximately 15 to 20 degrees.

4. An overhead storage cabinet comprising:

a top wall, a bottom wall, and first and second opposed side walls;

a door having opposed top and bottom edges and opposed side edges;

a pivot arm for moving said door between a closed position and a fully open position situated above said cabinet, said pivot arm having a first portion being rotatably mounted about a pivot point to one of said side walls and a second portion being secured to said door; and a force means coacting with said pivot arm for moving and counterbalancing said door as said door moves between said closed and fully open positions, one end of said force means being pivotally connected to said pivot arm at a connection point offset from said pivot point and the other end of said force means being pivotally connected to said side wall, said force means being only slightly offset from said pivot point thereby directing the force generated by said force means substantially through said pivot point when said door is in said closed position, and when movement of said door is initiated to cause said door to move to said open position, said connection point moves slightly forward toward said door, thereby redirecting the force generated by said force means to be essentially tangential to said pivot point thus permitting said door to move for the remainder of its travel solely under the force generated by said force means.

5. The overhead storage cabinet according to claim 4 wherein said force means comprises a reciprocable piston and cylinder.

6. The overhead storage cabinet according to claim 5 wherein said first portion of said pivot arm includes a disk portion and a protrusion perpendicularly adjacent to said disk portion.

7. The overhead storage cabinet according to claim 6 wherein said second portion of said pivot arm includes an elongated arm portion extending outwardly from said disk portion and having a mounting bracket at its far end opposite said disk portion.

8. The overhead storage cabinet according to claim 7 wherein said force means and said pivot arm are constructed and arranged to move said door without assistance at a continuous, controlled rate once said door is opened beyond a predetermined distance.

9. The overhead storage cabinet according to claim 8 wherein said predetermined distance equals a rotation angle of approximately 15 to 20 degrees.

10. The overhead storage cabinet according to claim 9 wherein said predetermined distance equals a rotation angle of approximately 15 degrees.

* * * * *